US005349835A

United States Patent [19]

Liao

[11] Patent Number: 5,349,835

[45] Date of Patent: Sep. 27, 1994

[54] CYLINDRICAL LOCK

[76] Inventor: Wu-chang Liao, No. 18, Alley 5, Lane 42, Tien Hsiang Street, Hsin Chuang, Taipei Hsien, Taiwan

[21] Appl. No.: 99,534

[22] Filed: Jul. 30, 1993

[51] Int. Cl.[5] ..... E05B 27/00

[52] U.S. Cl. ..... 70/491; 70/419

[58] Field of Search ..... 70/490, 491, 403, 404, 70/419, 423

[56] References Cited

U.S. PATENT DOCUMENTS

| | | | |
|---|---|---|---|
| 1,891,214 | 12/1932 | Falk | 70/491 X |
| 3,509,748 | 5/1970 | Trainor | 70/491 |
| 3,681,955 | 8/1972 | Sturgeon | 70/491 |
| 3,797,289 | 3/1974 | Mercurio | 70/491 |
| 4,233,828 | 11/1980 | Dauenbaugh | 70/491 |
| 4,653,297 | 3/1987 | Moorhouse | 70/419 X |
| 4,858,455 | 8/1989 | Kuo | 70/491 |
| 5,018,376 | 5/1991 | Lee | 70/491 |

FOREIGN PATENT DOCUMENTS

| | | | |
|---|---|---|---|
| 2182381 | 5/1987 | United Kingdom | 70/491 |

*Primary Examiner*—Peter M. Cuomo
*Assistant Examiner*—Suzanne L. Dino
*Attorney, Agent, or Firm*—Collier, Shannon, Rill & Scott

[57] ABSTRACT

An improved cylindrical lock comprising a housing, a lower pin seat mounted on the housing, a spindle, a plurality of springs, and plural sets of upper and lower pins. The spindle is constructed by a cylinder and an upper pin seat which is annular and circumferently provided with a plurality of holes. The upper portion of the upper pin seat is provided with an annular wall having a slit for accommodating the outward protruding wing of a key. The inner portion of the wall is provided with a plurality of semicircular grooves diametrically opposing the holes in the upper pin seat, so that one end of each semicircular groove communicates with the corresponding hole in order to form a longitudinal circular hole for receiving a set of springs and cylindrical pins and the other end of each semicircular groove is formed as a groove wall which can prevent the pins from being popped out. Thus, the cylindrical pins can only move between the semicircular grooves and the holes. Even after the cylindrical key is used for a long period, the slit of the housing for accommodating the outward protruding wing will be widened due to the friction therebetween resulted from insertion of the outward protruding wing of the key, the pins still can not be popped out of the lock and destroy the main effect of the lock.

2 Claims, 3 Drawing Sheets

CYLINDRICAL LOCK

BACKGROUND OF THE INVENTION

Cylindrical locks are well known and have been widely used in computers, TV games, elevators, doors, motorcycles, etc., for a long time. The above cylindrical locks (as shown in FIGS. 1 and 2) are constructed by a housing 101, a lower pin seat 102 mounted in the housing 101, a spindle 103, a plurality of springs 104, and plural sets of upper and lower pins 105. However, such a construction has following disadvantages:

(1) As shown in FIG. 2, during assembly of the pins 105, pins 105 are inserted into the spindle 103 by operators, and pressed against the housing 101 by means of the springs 104. Hence, the pins 105 may be easily popped out of the spindle 103 due to an undesired collision between the housing 101 and the spindle 103 as a result of improper movement of either housing or spindle by operators. Therefore, skilled persons are required to prevent the waste of time to repeat assembly work which, however, substantially increases costs.

(2) In order to prevent the removal of the pins 105 from the spindle and facilitate the assembly, the gap between the housing 101 and the spindle 103 and the lower pin seat 102 should be enlarged. However, such a gap permits the spindle to sway or have angular movement and, hence, a smooth rotation of the spindle 103 can not be obtained.

(3) As shown in FIG. 1, if the opening 111 of the of the housing 101 is too large or enlarged by an external force or the friction of the outward protruding wing 61 of the key after a short period of use, the pins 105 will be easily popped out and the lock can not work.

The present invention aims at eliminating the above said disadvantages, and provides an improved cylindrical lock, where the pins will not be easily popped out, and the top of the annular wall of the spindle can tightly press against the housing, so that the spindle will not sway. Further, the angular position of the spindle of the present invention is more precise and its rotation is also more smooth.

The present invention will become apparent from the detailed description with reference to the accompanying drawings which are given by way of illustration only, and thus are not limitative of this invention.

DETAILED DESCRIPTION OF PREFERRED EMBODIMENT

Figure 6:
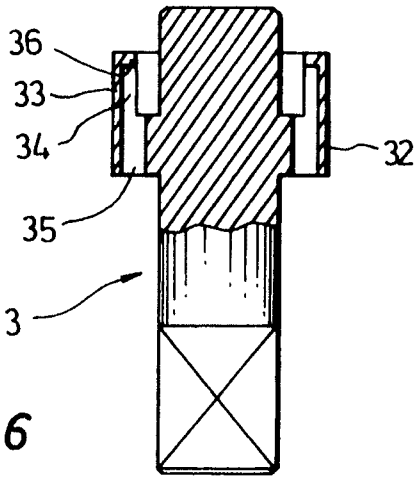
FIG. 6 is a partial sectional view of the improved cylindrical lock of FIG. 3.

As shown in FIGS. 3–6, the improved cylindrical lock according to the first embodiment of the present invention is composed of a housing 1, a lower pin seat 2 mounted on the housing 1, a spindle 3, a plurality of springs 4, and plural sets of upper and lower pins 5. The spindle 3 is constructed by a cylinder 31 and an upper pin seat 32 which is annular and circumferently provided with a plurality of holes 35. The upper portion of the upper pin seat 32 is provided with a wall 33 having a slit 37 for accommodating the outward protruding wing 61 of a key 6. The inner portion of the wall 33 is provided with a plurality of semicircular grooves 34 diametrically opposing the holes 35 in the upper pin seat 32, where one end of each semicircular groove 34 communicates with the corresponding hole 35 in order to form a longitudinal circular hole for receiving a set of spring 4 and cylindrical pins 5, and the other end of each semicircular groove 34 is a groove wall 36 which can prevent said pins from being popped out (as shown in FIG. 6).

Figure 4:
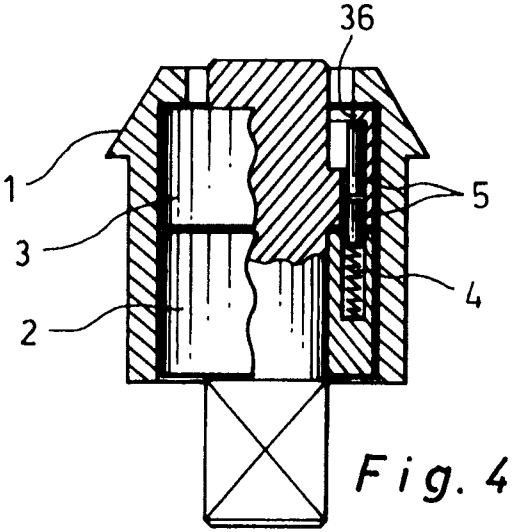
FIG. 4 is a sectional view of the improved cylindrical lock of FIG. 3.

Concerning the improved cylindrical lock stated above, its main characteristic resides in that a groove wall 36 is provided on the annular wall 33 of the spindle 3 for preventing the removal of the pins 5. Thus, the cylindrical pins 5 can only move between the semicircular grooves 34 and the holes 35 (as shown in FIG. 4).

In no circumstance will pins 5 be popped out of the lock under normal operation. Even after a long period of use, the slit 11 of housing 1 for accommodating the outward protruding wing 61 will be widened due to the friction therebetween as a result of insertion of the outward protruding wing 61, the pins 5 still can not be popped out of the lock and destroy the main effect of the lock.

Further, during the assembly of the lock of the present invention, the pins 5 can not be popped out of the lock even when an undesired collision between the housing 1 and the spindle 3 occurs due to improper movement of either housing or spindle made by operators. Thus, it is possible to fast assemble the lock of the present invention without experienced workers.

Since the pins 5 are stopped by the groove wall 36 of the annular wall 33, they do not directly touch the housing 1. The spindle 3 is biased against the springs 4 and the pins 5, so that the top of the annular wall 33 of the spindle 3 can rest against the housing 1. Because there is no clearance between the spindle 3 and the housing 1, the spindle 3 may rotate smoothly within the housing 1.

Figure 1:
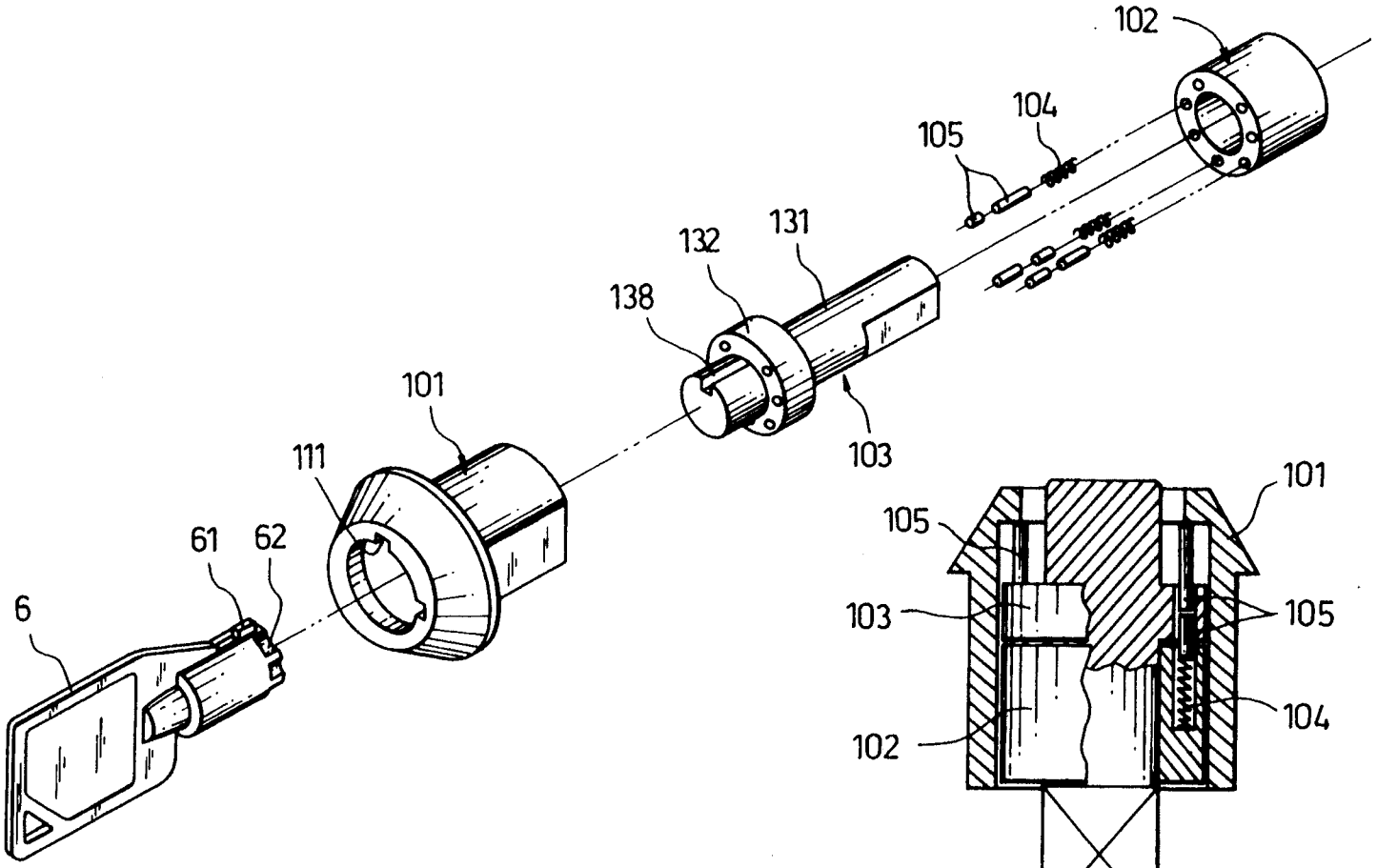
FIG. 1 is an exploded view of the conventional cylindrical lock and key.
Figure 2:
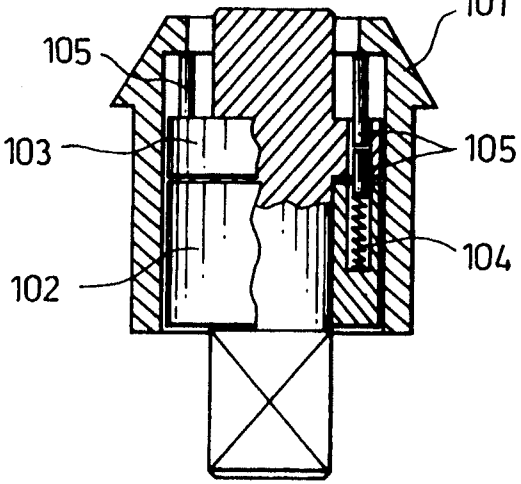
FIG. 2 is a sectional view of the conventional cylindrical lock of FIG. 1.
Figure 5:
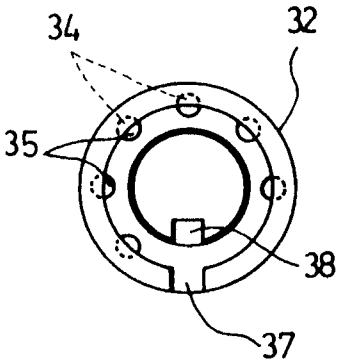
FIG. 5 is a top view of the improved cylindrical lock of FIG. 3.
Figure 3:
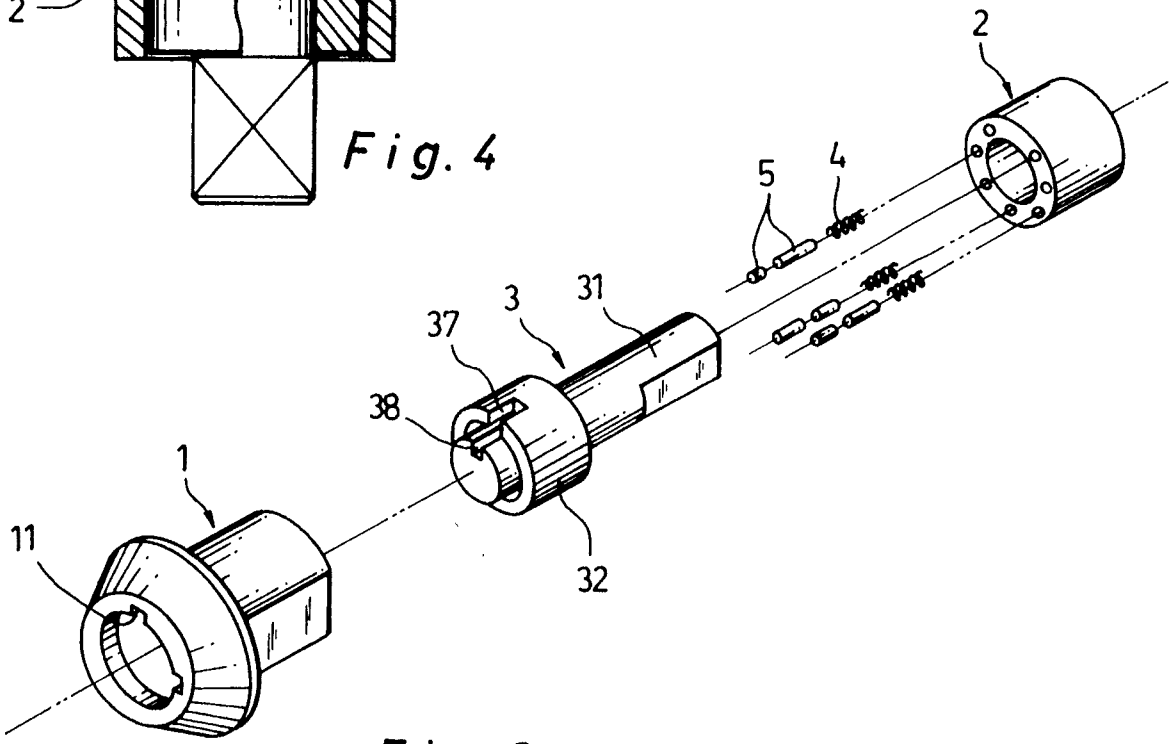
FIG. 3 is an exploded view of the improved cylindrical lock according to a first preferred embodiment of the present invention.

In the present invention, the cylinder 31 of the spindle 3 may be provided with a slot 38 (as shown in FIG. 3). It is well known that in the spindle 103 of the conventional cylindrical lock (as shown in FIG. 1), the cylinder 131 should be provided with a slot 138 in order to be rotated by the inner protruding wing (not shown) of the key 6 after insertion of the inner protruding wing, where the outer protruding wing 61 is merely used for stabilization. However, in the present invention, the annular wall 33 of the spindle is provided with a slit 37 which cooperates with the outer protruding wing 61 of the key, in order to stably rotate the spindle 3 without the use of such a slot 38. Hence, it is unnecessary to provide an inner protruding wing in the key 6. Such a structure not only can save the cost of material and mold, but also can prevent the insertion of the special tool made by the intruder in order to increase the safety of the lock. Furthermore, the diameter of the actuating portion of the spindle 3 is larger than that of the conventional cylindrical lock, hence the opening and closing of the lock according to the present invention will be easier and the angular positioning of the key can be more precise.

Figure 7:
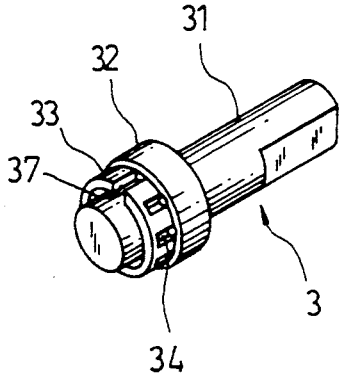
FIG. 7 is a perspective view of the spindle of a second embodiment of the present invention, where the diameter of the annular wall is further narrowed.
Figure 8:
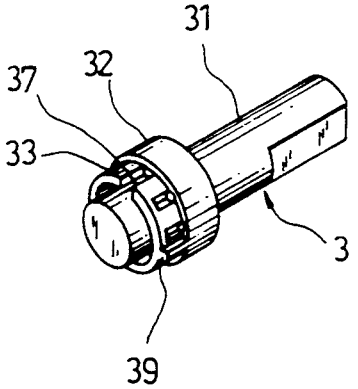
FIG. 8 is a perspective view of the spindle of a third embodiment of the present invention, where a stopper protrusion is provided on the annular wall of the spindle.

In the second embodiment of the present invention, the upper portion of the annular wall 33 on the upper pin seat of the spindle 3 can be partially cut off to expose the bottom of the semicircular grooves 34 (as shown in FIG. 7). Therefore, during the assembly of the lock, the key teeth may be visible when the key 6 is temporarily inserted into the spindle. This may facilitate the insertion of the pins 5 with different length. 3. In the third embodiment of the present invention, a stopper protrusion 39 is provided on the outer portion of the annular wall 33 of the spindle 3 (as shown in FIG. 8), and a groove (not shown) is provided on the inner wall of the housing 1 for accommodating the stopper protrusion 39 in order to confine the angular movement of the spindle 3 in a proper range during use without the use of an additional member of angular movement stopper. Therefore, during the assembly of the present invention such an additional angular movement stopper can be omitted and the assembling efficiency can be improved.

Additional advantages and modifications will readily occur to those skilled in the art. Therefore, the invention in its broader aspects is not limited to the specific details, and representative locks, shown and described herein. Accordingly, various modifications may be made without departing from the spirit or scope of the general inventive concept as defined by the appended claims and their equivalents.

I claim:

1. An improved cylindrical lock comprising:

a housing;

a lower pin seat mounted in said housing;

a spindle;

a plurality of springs; and plural sets of upper and lower cylindrical pins, wherein said spindle is a cylinder and an annular upper pin seat circumferentially provided with a plurality of holes;

an upper portion of said upper pin seat is provided with an annular wall having a slit for accommodating an outward protruding wing of a key;

an inner portion of said annular wall is provided with a plurality of semi-cylinder-shaped grooves that communicate with a corresponding hole in order to form a longitudinal cylinder-shaped hole for receiving a set of springs and cylindrical pins, one end of each of said semi-cylinder-shaped grooves is formed as a grooved wall in order to prevent said pins from popping out of said hole, said upper portion of said annular wall on said upper pin seat of said spindle is partially cut to expose a bottom portion of said semi-cylinder-shaped grooves, so that said pins are visible during assembly in order to facilitate said assembly of said pins when a key is temporarily inserted into said spindle.

2. The improved cylindrical lock as described in claim 1, wherein an outer portion of said wall of said spindle further comprises a stopper protrusion for accommodating a groove provided on an inner wall of said housing in order to confine angular movement of said spindle.

* * * * *